US011254532B2

(12) United States Patent
Arimori

(10) Patent No.: US 11,254,532 B2
(45) Date of Patent: Feb. 22, 2022

(54) MEDIUM TRANSPORT APPARATUS, IMAGE READING APPARATUS, AND TRANSPORT CONTROL METHOD

(71) Applicant: SEIKO EPSON CORPORATION, Tokyo (JP)

(72) Inventor: Kazuhiko Arimori, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 153 days.

(21) Appl. No.: 16/696,223

(22) Filed: Nov. 26, 2019

(65) Prior Publication Data

US 2020/0172357 A1 Jun. 4, 2020

(30) Foreign Application Priority Data

Nov. 30, 2018 (JP) ..... JP2018-224975

(51) Int. Cl.

*B65H 7/18* (2006.01)
*B65H 7/02* (2006.01)
*B65H 3/06* (2006.01)

(52) U.S. Cl.

CPC ..... *B65H 7/18* (2013.01); *B65H 3/0607* (2013.01); *B65H 7/02* (2013.01)

(58) Field of Classification Search

CPC ..... B65H 3/06; B65H 3/063; B65H 3/5284; B65H 7/02; B65H 7/06; B65H 7/08; B65H 7/10; B65H 7/18; B65H 2511/52; B65H 2511/522; B65H 2511/528; B65H 2553/416; B65H 2601/11; B65H 2601/255

See application file for complete search history.

(56) References Cited

U.S. PATENT DOCUMENTS

| | | | | |
|---|---|---|---|---|
| 7,138,620 | B2 | 11/2006 | Trisnadi et al. | |
| 7,459,671 | B2 | 12/2008 | Trisnadi et al. | |
| 7,971,867 | B2 * | 7/2011 | Shiraiwa | B65H 3/06 271/10.01 |
| 2006/0091301 | A1 | 5/2006 | Trisnadi et al. | |
| 2006/0159471 | A1 | 7/2006 | Yasukawa et al. | |
| 2007/0057157 | A1 | 3/2007 | Trisnadi et al. | |
| 2007/0237558 | A1 | 10/2007 | Nakanishi et al. | |
| 2008/0197562 | A1 | 8/2008 | Yoshida et al. | |

(Continued)

FOREIGN PATENT DOCUMENTS

| | | |
|---|---|---|
| CN | 101048843 | 9/2011 |
| JP | 2003205654 | 7/2003 |

(Continued)

*Primary Examiner* — Prasad V Gokhale
(74) *Attorney, Agent, or Firm* — Workman Nydegger

(57) ABSTRACT

A medium transport apparatus includes: a medium mounting section configured to mount a medium; a feed roller configured to feed the medium from the medium mounting section; a separation roller configured to nip and separate the medium from the feed roller; a plurality of sensors disposed at positions facing a surface of the medium and configured to detect movement of the medium; and a control unit configured to stop feeding of the medium based on detection values received from the sensors, wherein the plurality of sensors are disposed upstream of a nipping position by the feed roller and the separation roller with a gap in a width direction being a direction intersecting a medium feed direction and detect movement of the medium in the width direction.

7 Claims, 7 Drawing Sheets

(56) References Cited

U.S. PATENT DOCUMENTS

| | | | | |
|---|---|---|---|---|
| 2008/0210605 | A1* | 9/2008 | Park | B65H 83/025<br>209/534 |
| 2008/0265497 | A1* | 10/2008 | Kimura | B65H 3/063<br>271/228 |
| 2010/0258997 | A1* | 10/2010 | Lee | B65H 7/14<br>271/3.16 |
| 2019/0100396 | A1* | 4/2019 | Shiota | B65H 3/063 |
| 2019/0253576 | A1* | 8/2019 | Masaru | B65H 7/14 |

FOREIGN PATENT DOCUMENTS

| | | |
|---|---|---|
| JP | 2006193286 | 7/2006 |
| JP | 2007276982 | 10/2007 |
| JP | 2008201517 | 9/2008 |
| JP | 2019029794 | 2/2019 |

* cited by examiner

MEDIUM TRANSPORT APPARATUS, IMAGE READING APPARATUS, AND TRANSPORT CONTROL METHOD

The present application is based on, and claims priority from JP Application Serial Number 2018-224975, filed Nov. 30, 2018, the disclosure of which is hereby incorporated by reference herein in its entirety.

BACKGROUND

1. Technical Field

The present disclosure relates to a medium transport apparatus that transports a medium and an image reading apparatus including the medium transport apparatus. The present disclosure also relates to a transport control method in a medium transport apparatus.

2. Related Art

To date, jam detection has been performed by various methods in image reading apparatuses and recording apparatuses. For example, JP-A-2008-201517 discloses a sheet feeder for determining the occurrence of a paper feed jam by the following method. In the sheet feeder, a sheet loading tray is provided with a driven roller that is rotated in accordance with movement of a sheet, and the rotation of the driven roller is detected by a rotary encoder to obtain the amount of the sheet movement. If a paper feed sensor disposed downstream of a pick roller does not detect the sheet while the sheet is moved for a predetermined amount, a determination is made that a paper feed jam has occurred.

In the method of determining a jam using a paper feed sensor disposed downstream of a pick roller, such as the sheet feeder disclosed in JP-A-2008-201517, it is necessary to drive a pick roller as much as needed for a sheet front end to reach the paper feed sensor. Accordingly, it takes time for determining a jam, and at the time that the jam is determined, the sheet might have suffered serious damage.

SUMMARY

According to an aspect of the present disclosure, there is provided a medium transport apparatus including: a medium mounting section configured to mount a medium; a feed roller configured to feed the medium from the medium mounting section; a separation roller configured to nip and separate the medium from the feed roller; a plurality of sensors disposed at positions facing a surface of the medium and configured to detect movement of the medium; and a control unit configured to stop feeding of the medium based on detection values received from the sensors, wherein the plurality of sensors are disposed upstream of a nipping position by the feed roller and the separation roller with a gap in a width direction being a direction intersecting a medium feed direction and may detect movement of the medium in the width direction.

DESCRIPTION OF EXEMPLARY EMBODIMENTS

Figure 1:
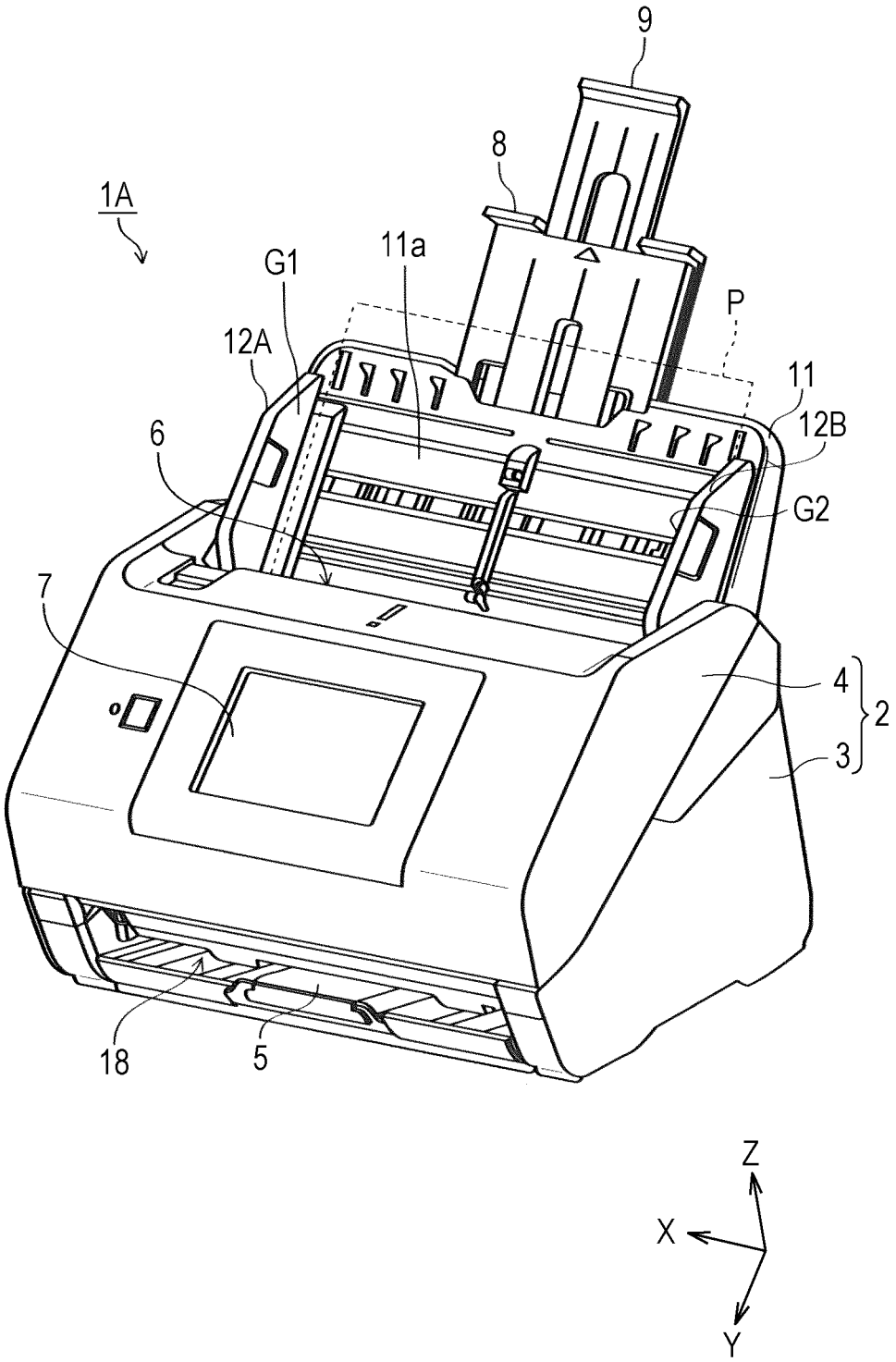
FIG. 1 is an outer perspective view of a scanner.

In the following, a description will be schematically given of the present disclosure. According to a first aspect, there is provides a medium transport apparatus including: a medium mounting section configured to mount a medium; a feed roller configured to feed the medium from the medium mounting section; a separation roller configured to nip and separate the medium from the feed roller; a plurality of sensors disposed at positions facing a surface of the medium and configured to detect movement of the medium; and a control unit configured to stop feeding of the medium based on a detection value received from the sensors, wherein the plurality of sensors are disposed upstream of a nipping position by the feed roller and the separation roller with a gap in a width direction being a direction intersecting a medium feed direction and detect movement of the medium in the width direction.

With this aspect, the plurality of sensors that detect the movement of the medium are disposed upstream of the nipping position by the feed roller and the separation roller with a gap in a width direction being a direction intersecting a medium feed direction and detect movement of the medium in the width direction. Accordingly, it is possible for the control unit to obtain the movement of the medium more promptly and correctly than the related-art technique based on the plurality of detection value obtained from the plurality of sensors and to suppress damage formation on the medium.

According to a second aspect, in the medium transport apparatus according to the first aspect, the plurality of sensors may include a first sensor and a second sensor disposed by sandwiching the feed roller and the separation roller therebetween in the width direction; and when both a movement of the medium in the width direction obtained by the first sensor and a movement of the medium in the width direction obtained by the second sensor are directed to the feed roller, and an amount of the movement exceeds a threshold value, the control unit may stop feeding of the medium.

In the state in which a medium front end is jammed at a nipping position between the feed roller and the separation roller and does not proceed downstream, when the feed roller continues to be rotated, the medium tends to be drawn to the nipping position of the feed roller and the separation roller, which causes a crease. In this aspect, the plurality of sensors may include a first sensor and a second sensor disposed by sandwiching the feed roller and the separation roller therebetween in the width direction, and when both a movement of the medium in the width direction obtained by the first sensor and a movement of the medium in the width direction obtained by the second sensor are directed to the feed roller, and an amount of the movement exceeds a threshold value, the control unit may stop feeding of the medium. Accordingly, it is possible to suitably detect the state of causing a crease as described above, to detect a jam eventually in an early stage, and to suitably suppress damage formation on the medium.

According to a third aspect, in the medium transport apparatus according to the first aspect, the plurality of sensors may include a downstream sensor located closer to an edge of the medium than the nipping position in the width direction, and an upstream sensor located upstream of the downstream sensor in the medium feed direction and disposed at a feed center position in the width direction, and when a movement in the width direction obtained by the downstream sensor is larger than a movement in the width direction obtained by the upstream sensor, and a difference thereof exceeds a threshold value, the control unit may stop feeding of the medium. As described above, when the medium is drawn to the nipping position of the feed roller and the separation roller and causes a crease, the movement in the width direction obtained by the downstream sensor becomes larger than the movement in the width direction obtained by the upstream sensor, and the difference therebetween exceeds the threshold value. With this aspect, such a movement is detected and the feeding of the medium is stopped. Accordingly, it is possible to suitably detect the state of causing a crease as described above, to detect a jam eventually in an early stage, and to suitably suppress damage formation on the medium.

According to a fourth aspect, there is provided a medium transport apparatus including: a medium mounting section configured to mount a medium; a feed roller configured to feed the medium from the medium mounting section; a separation roller configured to nip and separate the medium from the feed roller; a plurality of sensors disposed at positions facing a surface of the medium and configured to detect movement of the medium; and a control unit configured to stop feeding of the medium based on detection values received from the sensors, wherein the plurality of sensors are disposed upstream of the nipping position by the feed roller and the separation roller with a gap and detect movement of the medium in the medium feed direction.

With this aspect, the plurality of sensors are disposed upstream of the nipping position by the feed roller and the separation roller with a gap in the width direction being a direction intersecting a medium feed direction and detect movement of the medium in the medium feed direction. Accordingly, compared with the related-art technique, it is possible for the control unit to promptly and correctly obtain the movement of the medium based on a plurality of detection values obtained from the plurality of sensors, and to suppress damage formation on the medium.

According to a fifth aspect, in the medium transport apparatus according to the fourth aspect, the plurality of sensors may include a first sensor and a second sensor, a distance from one of corners of a medium front end to the first sensor is shorter than a distance from the corner to the second sensor, and when a difference between a detection value of the first sensor and a detection value of the second sensor exceeds a threshold value, the control unit may stop feeding of the medium.

When a plurality of sheets of the medium is mounted on the medium mounting section while the sheets are bound by a stale, or the like, and the feed operation is started, the medium that receives a feeding force from the feed roller is rotated with the bound position as center. With this aspect, the plurality of sensors include a first sensor and a second sensor, the distance from one of corners of a medium front end to the first sensor is shorter than the distance from the corner to the second sensor. Accordingly, when the medium is rotated as described above, the difference arises between the detection value of the first sensor and the detection value of the second sensor. If the difference between the detection value of the first sensor and the detection value of the second sensor exceeds the threshold value, the control unit stops feeding the medium. Accordingly, it is possible to detect the rotation of the medium as described above in an early stage, to detect a jam early, and to suitably suppress damage formation on the medium early.

According to a sixth aspect, in the medium transport apparatus according to the fourth aspect, the plurality of sensors may include a first sensor, a second sensor, and a third sensor, among distances from one corner of the medium front end to each of the sensors, a distance from the corner to the first sensor may be shortest, a distance from the corner to the second sensor may be longest, and when a detection value by the first sensor is lowest, and a detection value by the second sensor is highest, and a difference when a detection value by the third sensor is subtracted from a detection value of the second sensor exceeds a first threshold value, and a difference when a detection value by the first sensor is subtracted from a detection value of the second sensor exceeds a second threshold value, the control unit may stop feeding of the medium.

With this aspect, the plurality of sensors include a first sensor, a second sensor, and a third sensor, among distances from one of corners of a medium front end to each of the sensors, the distance from the corner to the first sensor is shortest, and the distance from the corner to the second sensor is longest. When the medium is rotated as described above, a difference arises among the detection value of each sensor. When a detection value by the first sensor is lowest, and a detection value by the second sensor is highest, and a difference when a detection value by the third sensor is subtracted from a detection value of the second sensor exceeds a first threshold value, and the difference when a detection value by the first sensor is subtracted from a detection value of the second sensor exceeds a second threshold value, the control unit stops feeding of the medium. Accordingly, it is possible to detect the rotation of the medium as described above in an early stage, to detect a jam early, and to suitably suppress damage formation on the medium early.

According to a seventh aspect, in the medium transport apparatus according to the first aspect, the sensors may be two-dimensional sensors that detect a movement of the medium in a two-dimensional coordinate system including a first axis and a second axis. With this aspect, since the sensors are two-dimensional sensors that detect a movement of the medium in a two-dimensional coordinate system including a first axis and second axis. With this aspect, the sensors may be two-dimensional sensors that detect a movement of the medium in a two-dimensional coordinate system including a first axis and second axis. Accordingly, it is possible to suitably detect a movement of the medium in the transport direction.

An image reading apparatus according to an eighth aspect includes: a reading unit configured to read a medium; and the medium transport apparatus according to the first aspect that transports the medium to the reading unit. With this aspect, it is possible for the image reading apparatus to obtain the operational advantages described above.

According to a ninth aspect, there is provided a method of controlling transport in a transport apparatus including: a medium mounting section configured to mount a medium, a feed roller configured to feed the medium from the medium mounting section, a separation roller configured to nip and separate the medium from the feed roller, a plurality of sensors disposed at positions facing a surface of the medium and configured to detect movement of the medium, wherein the plurality of sensors are disposed upstream of a nipping position by the feed roller and the separation roller with a gap in a width direction being a direction intersecting a medium feed direction and detect movement of the medium in the width direction, the method includes: stopping feeding of the medium based on a plurality of detection values obtained from the plurality of sensors.

With this aspect, a plurality of sensors that detect movement of the medium are disposed upstream of a nipping position by the feed roller and the separation roller with a gap in a width direction being a direction intersecting a medium feed direction and detects movement of the medium in the width direction. Accordingly, compared with the related-art technique, it is possible to more promptly and correctly obtain the movement of the medium based on a plurality of detection values obtained from the plurality of sensors, and to suppress damage formation on the medium.

According to a tenth aspect, there is provided a method of controlling transport in a medium transport apparatus including a medium mounting section configured to mount a medium, a feed roller configured to feed the medium from the medium mounting section, a separation roller configured to nip and separate the medium from the feed roller, a plurality of sensors disposed at positions facing a surface of the medium and configured to detect movement of the medium, wherein the plurality of sensors are disposed upstream of a nipping position by the feed roller and the separation roller with a gap in a width direction being a direction intersecting a medium feed direction and detect movement of the medium in the medium feed direction, the method including: stopping feeding of the medium based on a plurality of detection values obtained from the plurality of sensors.

With this aspect, the plurality of sensors are disposed upstream of a nipping position by the feed roller and the separation roller with a gap in a width direction being a direction intersecting a medium feed direction and detects movement of the medium in the medium feed direction. Accordingly, compared with the related-art technique, it is possible to more promptly and correctly obtain the movement of the medium based on a plurality of detection values obtained from the plurality of sensors, and to suppress damage formation on the medium.

In the following, the present disclosure will be specifically described. A description will be given of an image reading apparatus according to an embodiment with reference to the drawings. In the present embodiment, as an example of the image reading apparatus, a description will be given of a document scanner (hereinafter simply referred to as a scanner 1A) configured to read at least one of the front face and the back face of a document P.

In this regard, in the X-Y-Z coordinate system illustrated in each diagram, the X-direction is the width direction of the apparatus and is also the document width direction, which intersects the document transport direction. Also, the Y-direction is the document transport direction. The Z-direction is the direction that intersects the Y-direction and roughly indicates the direction perpendicular to the face of the document P to be transported. Also, it is assumed that +Y-direction is the direction heading from the back face to the front face of the apparatus, and −Y-direction is the direction heading from the front face to the back face of the apparatus. Also, it is assumed that the left direction seen from the apparatus front face is +X-direction, and the right direction is −X-direction. Also, it is assumed that +Z-direction is the up direction of the apparatus, and −Z-direction is the down direction of the apparatus. Also, it is assumed that the direction (+Y-direction) in which the document P is transported is referred to as "downstream" and the opposite direction (−Y-direction) to this is referred to as "upstream".

FIG. 1 is an outer perspective view of the scanner 1A according to the present disclosure. The scanner 1A includes an apparatus body 2 that includes a reader 20 (FIG. 2) for reading an image of the document P. The apparatus body 2 includes a lower unit 3 and an upper unit 4. The upper unit 4 is disposed so as to be openable and closable with respect to the lower unit 3 with a downstream point in the document transport direction as a rotation fulcrum. It is possible to open the upper unit 4 by rotating the upper unit 4 in the front face direction of the apparatus and to expose the document transport path of the document P so as to easily handle the jam of the document P.

A document mounting section 11 having a mounting face 11*a* on which the document P to be fed is mounted is disposed close to the apparatus back face of the apparatus body 2. The document mounting section 11 is detachably disposed with respect to the apparatus body 2. Also, the document mounting section 11 is provided with a pair of edge guides, specifically, a first edge guide 12A and a second edge guide 12B that guide the side edges of the document P in the width direction (X-axis direction) of the feed direction (Y-axis direction) of the document P. The first edge guide 12A and the second edge guide 12B include guide faces G1 and G2 respectively that guide the corresponding side edges of the document P.

The document mounting section 11 includes a first paper support 8 and a second paper support 9. It is possible to store the first paper support 8 and the second paper support 9 inside the document mounting section 11, to pull out the first paper support 8 and the second paper support 9 from the document mounting section 11 as illustrated in FIG. 1, and to adjust the length of the mounting face 11*a*.

The apparatus body 2 includes, on the apparatus front face of the upper unit 4, an operation panel 7 that enables a user interface (UI) by which various reading settings and reading operations are performed and reading setting contents, and the like are displayed. In the present embodiment, the operation panel 7 is a so-called touch panel that enables both display and input operations. The operation panel 7 serves both an operation section for performing various operations and a display section for displaying various kinds of information. A feed opening 6 that connects to the inside of the apparatus body 2 is disposed at the upper part of the upper unit 4, and the document P mounted on the document mounting section 11 is transported from the feed opening 6 to the reader 20 disposed inside the apparatus body 2. Also, a paper discharge tray 5 that receives the discharged document P is disposed on the apparatus front face of the lower unit 3.

Figure 2:
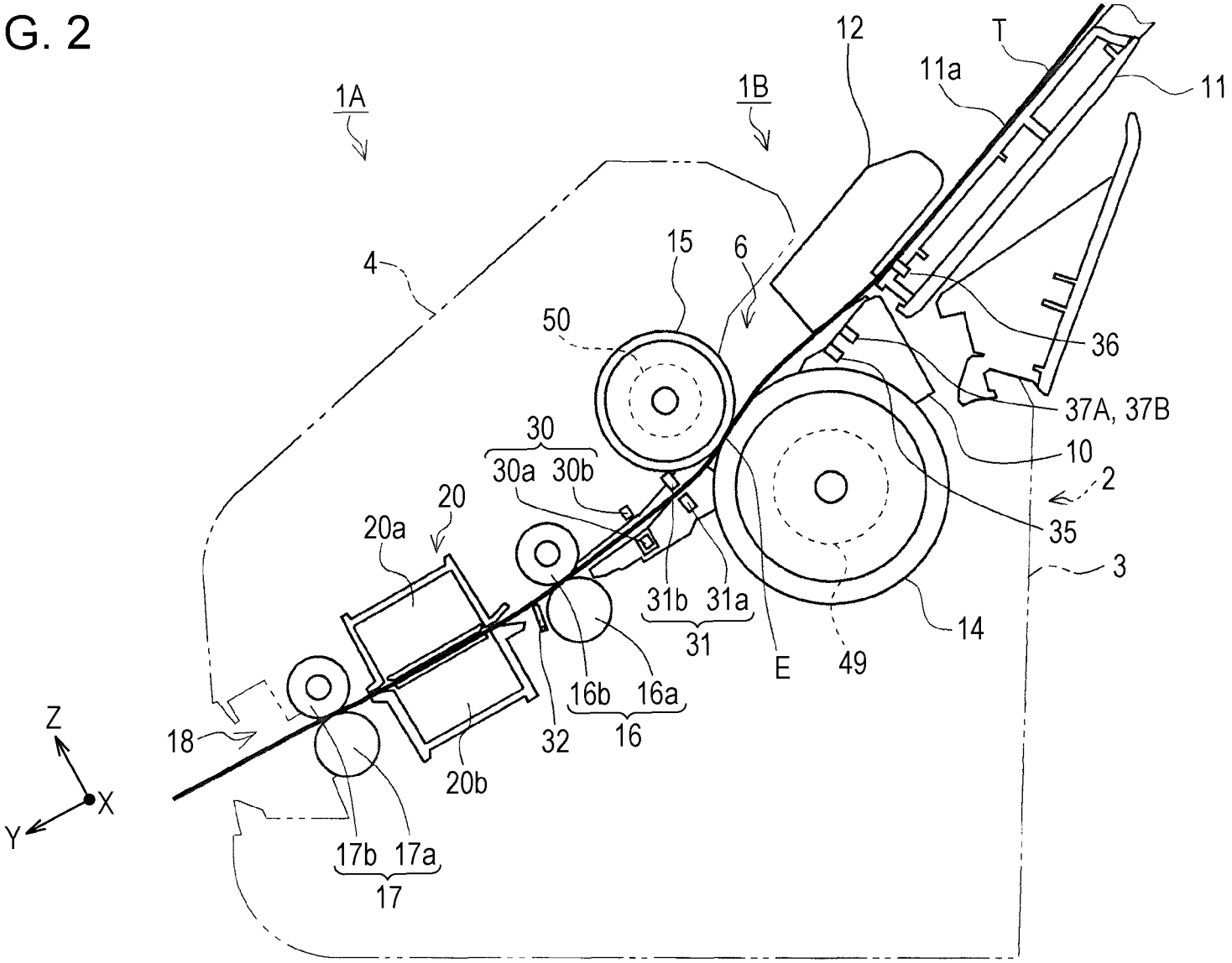
FIG. 2 is a sectional side view illustrating a document transport path in the scanner.
Figure 3:
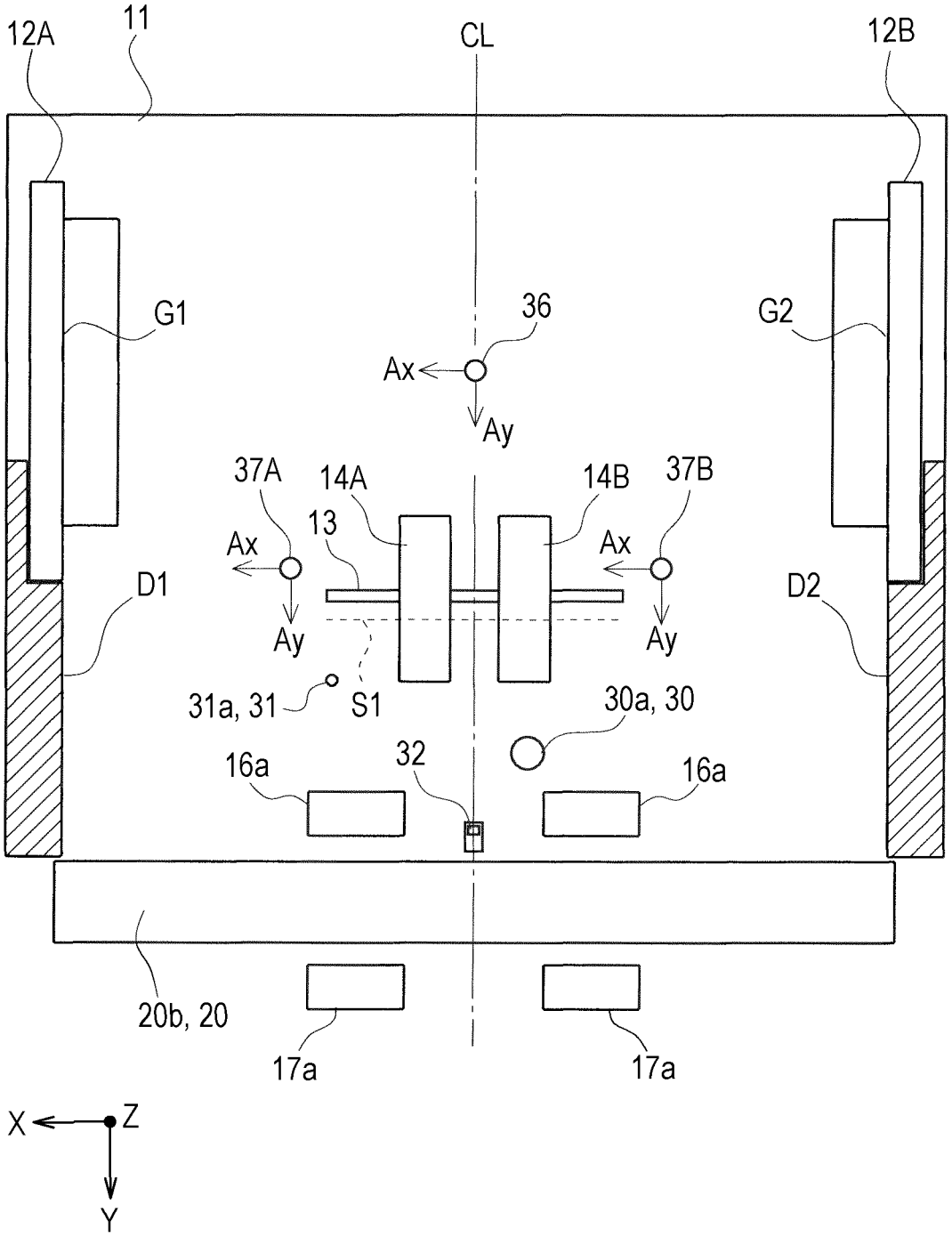
FIG. 3 is a plan view illustrating the document transport path in the scanner.

Next, a description will be given of the document feed path in the scanner 1A with reference to FIG. 2 and FIG. 3. FIG. 2 is a sectional side view illustrating the document feed path in the scanner 1A according to the present disclosure, and FIG. 3 is a plan view thereof. The scanner 1A includes a medium transport apparatus 1B (FIG. 2). The medium transport apparatus 1B is considered to be an apparatus produced by removing a document reading function, specifically, a reader 20 described later from the scanner 1A. However, even if the reader 20 is included, when focus is given to a viewpoint of document transport, it is possible to consider the scanner 1A itself as a medium transport apparatus. A sign T denoted by a solid line in FIG. 2 indicates the document feed path, in other words, the passing locus of the document P. The document feed path T is a space sandwiched by the lower unit 3 and the upper unit 4.

The uppermost stream of the document feed path T is provided with the document mounting section 11. The downstream of the document mounting section 11 is provided with a feed roller 14 that transports the document P mounted on the mounting face 11*a* of the document mounting section 11 to the reader 20 and a separation roller 15 that nips and separates the document P from the feed roller 14. A sign E in FIG. 2 denotes the document nipping position between the feed roller 14 and the separation roller 15. A pair of the feed roller 14 and the separation roller 15 becomes an example of transport unit that transport the document P downstream.

The feed roller 14 comes in contact with the lowermost part of the document P mounted on the mounting face 11*a* of the document mounting section 11. Accordingly, when a plurality of sheets of the document P is set in the document mounting section 11 in the scanner 1A, a sheet of the document P on the side of the mounting face 11*a* is fed downstream in order.

As illustrated in FIG. 3, in the present embodiment, the feed roller 14 includes two rollers such that the rollers are line symmetrical with respect to a center position CL in the document width direction. In FIG. 3, the feed roller 14 on the left side of the center position CL is denoted by a sign 14A, and the feed roller 14 on the right side of the center position CL is denoted by a sign 14B. Although illustration is omitted in FIG. 3, in the same manner, the separation roller 15 also includes two rollers such that the rollers are line symmetrical with respect to the center position CL. In this regard, a broken line S1 in FIG. 3 illustrates the front end position of the document P mounted on the document mounting section 11 before starting the feed operation. The front end of the document P mounted on the document mounting section 11 is regulated by a regulation member not illustrated in the figure so that the front end position is located at the position S1. When the feed operation is started, the regulation member moves to a retreat position.

Figure 4:
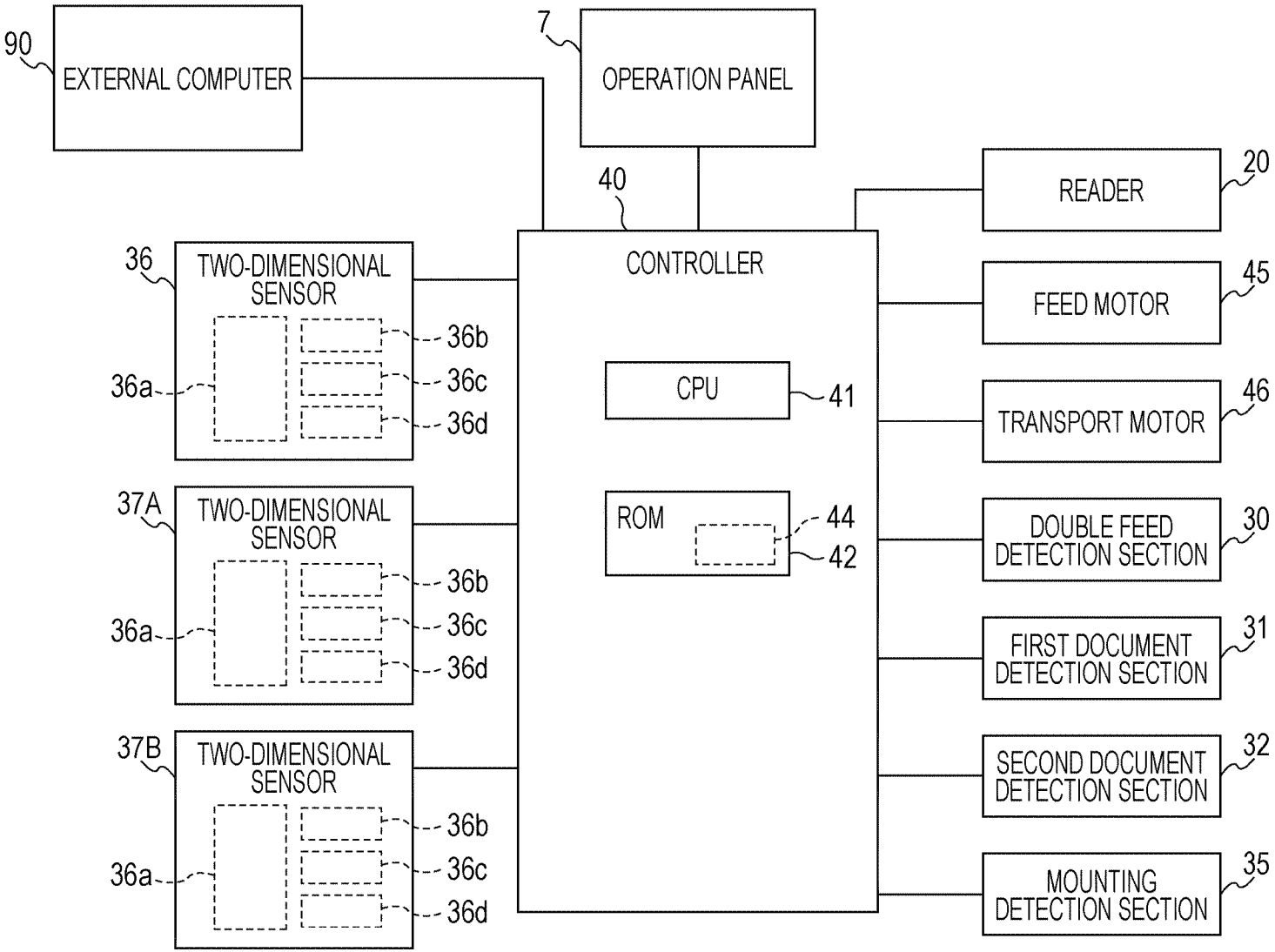
FIG. 4 is a block diagram illustrating a control system of the scanner.

The feed roller 14 is rotary driven by a feed motor 45 (FIG. 4). The feed roller 14 is rotated counterclockwise in FIG. 2 by being applied a rotational torque by the feed motor 45. A driving force of the feed motor 45 is transmitted to the feed roller 14 via a one-way clutch 49. The feed roller 14 is applied with a rotational torque from the feed motor 45 and is rotated counter clockwise in FIG. 2, that is to say, is rotated in a positive rotational direction so that the document P is fed downstream.

The driving force transmission path between the feed roller 14 and the feed motor 45 (FIG. 4) is provided with the one-way clutch 49, and thus when the feed motor 45 is reversely rotated, the feed roller 14 is not reversely rotated. Also, in the state in which the feed motor 45 is stopped, it is possible for the feed roller 14 to keep in contact with the document P transported, and to be rotated in the positive rotational direction. For example, when the front end of the document P is detected by a second document detection section 32 disposed downstream of the pair of transport rollers 16, the controller 40 stops driving of the feed motor 45 and drives only the transport motor 46. Thereby, the document P is transported by the pair of transport rollers 16, and the feed roller 14 is driven in positive rotational direction by keeping in contact with the document P.

Next, a transport motor 46 (FIG. 4) transmits a rotational torque to the separation roller 15 via a torque limiter 50. During the feed operation of the document P, the transport motor 46 (FIG. 4) transmits a drive torque to the separation roller 15 so as to rotate the separation roller 15 in the reverse rotational direction (counterclockwise in FIG. 2).

When the document P does not exist between the feed roller 14 and the separation roller 15, or when only one sheet lies therebetween, the rotational torque that causes the separation roller 15 to rotate in the positive rotational direction (clockwise in FIG. 2) exceeds the limit torque of the torque limiter 50. Thereby, a slip occurs in the torque limiter 50 so that the separation roller 15 is rotationally driven in the positive rotational direction in spite of the rotational torque applied from the transport motor 46 (FIG. 4).

In contrast, when the second and later sheet of the document P are further caught between the feed roller 14 and the separation roller 15 in addition to a sheet of the document P to be fed, a slip occurs among the sheets of the document. Thereby, the separation roller 15 is reversely rotated by the drive torque applied from the transport motor 46 (FIG. 4). Thereby, the second and later sheets of the document P to be doubly fed are returned upstream, that is to say, double feed of the document P is prevented.

In this regard, the outer circumference surfaces of the feed roller 14 and the separation roller 15 are formed by an elastic material, such as an elastomer, or the like. Assuming that the friction factor between the feed roller 14 and the separation roller 15 is $\mu 1$, the friction factor between the documents is $\mu 2$, the friction factor between the feed roller 14 and the document P is $\mu 3$, and the friction factor between the separation roller 15 and the document P is $\mu 4$, a relational expression $\mu 1 > \mu 2$ holds. Also, a relational expression $\mu 1 > \mu 3$ and $\mu 4$ holds. Also, a relational expression $\mu 2 < \mu 3$ and $\mu 4$ holds. Also, a relational expression $\mu 4 > \mu 3$ holds.

The downstream of the feed roller 14 is provided with the pair of transport rollers 16 as a transport unit, the reader 20 that reads an image, and a pair of discharge rollers 17. The pair of transport rollers 16 includes a transport drive roller 16*a* that is rotary driven by the transport roller motor 46 (FIG. 4) as a transport motor, and a transport driven roller 16*b* that is rotary driven. In the present embodiment, as illustrated in FIG. 3, the transport drive roller 16*a* includes two rollers such that the rollers are line symmetrical with respect to the center position CL. Although the transport driven roller 16*b* is omitted in FIG. 3, the transport driven roller 16*b* also includes two rollers such that the rollers are line symmetrical with respect to the center position CL in the same manner. The document P that has been nipped by the feed roller 14 and the separation roller 15, and has been fed downstream is nipped by the pair of transport rollers 16, and is transported to the reader 20 located downstream of the pair of transport rollers 16. That is to say, the pair of transport rollers 16 becomes an example of the transport unit that transports the document P downstream.

The reader 20 includes an upper part reading sensor 20*a* disposed on the upper unit 4 and a lower part reading sensor 20*b* disposed on the lower unit 3. In the present embodiment, the upper part reading sensor 20*a* and the lower part reading sensor 20*b* includes a contact-type image sensor module (CISM), for example.

The image of at least one of the front face and the back face of the document P is read by the reader 20, is nipped by the pair of discharge rollers 17 located downstream of the reader 20, and is discharged from a discharge opening 18 disposed on the apparatus front face of the lower unit 3. The pair of discharge rollers 17 includes a discharge drive roller 17*a* rotary driven by the transport roller motor 46 (FIG. 4)

and a discharge driven roller 17*b* that is rotary driven. In the present embodiment, as illustrated in FIG. 3, the discharge drive roller 17*a* includes two rollers such that the rollers are line symmetrical with respect to the center position CL. Although not illustrated in FIG. 3, the discharge driven roller 17*b* also includes two rollers such that the rollers are line symmetrical with respect to the center position CL in the same manner. The pair of discharge rollers 17 becomes an example of the transport unit that transports the document P downstream.

In the following, a description will be given of the control system in the scanner 1A with reference to FIG. 4. FIG. 4 is a block diagram illustrating the control system of the scanner 1A according to the present disclosure. In FIG. 4, as the control unit, the controller 40 performs feed, transport, discharge control of the document P and read control in addition to the other various kinds of control of the scanner 1A. The controller 40 receives a signal input from the operation panel 7. The controller 40 also transmits a signal for realizing display of the operation panel 7 and particularly the user interface (UI) to the operation panel 7.

The controller 40 controls the feed motor 45 and the transport motor 46. As described above, the feed motor 45 is the drive source of the feed roller 14 illustrated in FIG. 2, and the transport motor 46 is the drive source of the separation roller 15, the pair of transport rollers 16, and the pair of discharge rollers 17 illustrated in FIG. 2. Both the feed motor 45 and the transport motor 46 are DC motors in the present embodiment. The controller 40 receives input of read data from the reader 20, and the controller 40 also transmits a signal for controlling the reader 20 to the reader 20. The controller 40 also receives signals from the detection units, such as a mounting detection section 35 described later, two-dimensional sensors 36, 37A, and 37B, a double feed detection section 30, a first document detection section 31, and a second document detection section 32. The controller 40 also receives input of the detection values of an encoder that detects the rotation amount of the feed motor 45 and an encoder that detects the rotation amounts of the transport drive roller 16*a* and the discharge drive roller 17*a*. Thereby, it is possible for the controller 40 to detect the amount of document transport by each of the rollers.

The controller 40 includes a CPU 41 and a flash ROM 42. The CPU 41 performs various operation processing in accordance with a program 44 stored in the flash ROM 42 to control the operation of the entire scanner 1A. In this regard, the flash ROM 42, which is an example of a storage section, is a nonvolatile memory capable of reading and writing, and stores necessary data for abnormality determination, and the like. In this specification, unless otherwise described in particular, it is assumed that necessary data for abnormality determination described later, necessary parameter for control, and the like are all stored in the flash ROM 42, and the values thereof are updated by the controller 40 as necessary. Also, various kinds of setting information input by a user via the operation panel 7 is also stored in the flash ROM 42. The program 44 stored in the flash ROM 42 does not necessarily mean one program, and includes a plurality of programs. The programs include a program for determining abnormality in the document feed path T, a program for changing threshold values described later, a program for controlling the UI displayed on the operation panel 7, various control programs necessary for transporting and reading the document P, and the like.

Also, the scanner 1A is configured to connect to an external computer 90, and the controller 40 receives input of information from the external computer 90. The external computer 90 includes a display section not illustrated in FIG. 4. On the display section, a user interface (UI) is realized by a control program stored in a storage unit included in the external computer 90, which is not illustrated in FIG. 4.

Next, a description will be given of each detection unit disposed on the document feed path T. First, a two-dimensional sensor 36 is disposed on the document mounting section 11. Also, two-dimensional sensors 37A and 37B are disposed on the document mounting section 10. The two-dimensional sensor 36, 37A, and 37B are facing the lowest sheet of the document P mounted on the document mounting section 11. The two-dimensional sensor 36 is located upstream of the feed roller 14 in the document feed direction and at the center position CL in the document width direction. Also, the two-dimensional sensors 37A and 37B are located upstream of the feed roller 14 and downstream of the two-dimensional sensor 36 in the document feed direction, and disposed by sandwiching the feed roller 14 in the document width direction. More specifically, the two-dimensional sensors 37A and 37B are disposed at the positions that are line symmetrical with respect to the center position CL. Also, the two-dimensional sensors 37A and 37B are located on the closer side to the document edge than the feed roller 14 in the document width direction (the right side or the left side in FIG. 3). Accordingly, the two-dimensional sensors 37A and 37B function as a "downstream sensor", and the two-dimensional sensor 36 functions as an "upstream sensor". Also, in the present embodiment, the two-dimensional sensor 37A functions as the "first sensor", and the two-dimensional sensor 37B functions as the "second sensor".

In this regard, a reference numeral 13 denotes the rotation axis of the feed roller 14. The two-dimensional sensors 37A and 37B are located slightly upstream of the rotation axis 13 in the document feed direction and at the outside of the rotation axis 13 in the document width direction.

Also, when the document top is located at a position S1 at feeding start time, the distance from one corner of the document top (the corner C1 near a staple H in FIG. 7) to the two-dimensional sensor 37A becomes shortest, and the distance to the two-dimensional sensor 37B becomes the longest. Accordingly, the two-dimensional sensor 37A functions as the "first sensor", the two-dimensional sensor 37B functions as the "second sensor", and the two-dimensional sensor 36 functions as the "third sensor". In this regard, when the staple H is located not at the one corner C1 of the document top but at the other corner (corner C2 in FIG. 7), the two-dimensional sensor 37A functions as the "second sensor", the two-dimensional sensor 37B functions as the "first sensor", and the two-dimensional sensor 36 functions as the "third sensor".

The two-dimensional sensors 36, 37A, and 37B are sensors that are based on the same or a similar principle as a sensor configured to detect movement of a detection object on a two-dimensional (plane) coordinate system, which is used by a computer mouse. The two-dimensional sensors 36, 37A, and 37B have all the same configuration. Specifically, the two-dimensional sensor 36 includes a controller 36*a*, a light source 36*b*, a lens 36*c*, and an image sensor 36*d*. The light source 36*b* is a light source for irradiating the document P mounted on the document mounting section 11 with light via the lens 36*c*, and it is possible to employ a light source, for example, a red LED, an infrared LED, laser, a blue LED, and the like. In the present embodiment, laser light is used. The lens 36*c* guides the light emitted from the light source 36*b* to the document P mounted on the document mounting section 11.

The image sensor 36*d* is a sensor that receives reflected light from the document P mounted on the document mounting section 11, and may be an image sensor, such as a CMOS, a CCD, or the like. The image sensor 36*d* includes an array of pixels arranged in a first axis Ax direction and a second axis Ay direction perpendicular to the first axis Ax direction. In this regard, in the present specification, the "first axis Ax direction" does not mean either one of +Ax direction or −Ax direction, but means including the both directions. In the same manner, "second axis Ay direction" does not mean either one of +Ay direction or −Ay direction, but means including both of the directions. The controller 36*a* analyzes an image obtained by the image sensor 36*d* and outputs the movement distance Wx of the image in the first axis Ax direction and the movement distance Wy in the second axis Ay direction as detection values (output values). It is possible to use a publicly known method for the image analysis method performed by the controller 36*a*.

Although more specific description will be given later, the controller 40 obtains detection values in the first axis Ax direction and the second axis Ay direction from the two-dimensional sensors 36, 37A, and 37B. The controller 40 determines the transport state of a sheet of the document P that is mounted on the lowest position on the document mounting section 11 and in process of being transported using the obtained detection values. In this regard, the two-dimensional sensors 36, 37A, and 37B according to the present embodiment output respective movement distances Wx and Wy in the first axis Ax direction and the second axis Ay direction to the controller 40. The output values are reset to zero by an initialization instruction output by the controller 40.

In this regard, the description has been given of the two-dimensional sensors 36, 37A, and 37B that are configured to use an optical method as an example. However, the sensors may be configured to use a mechanical method, and more specifically, a mechanical sensor may be used that includes a track ball, a rotary encoder for detecting the rotation of the track ball in the first axis Ax direction, and a rotary encoder for detecting the rotation of the track ball in the second axis Ay direction.

Next, a mounting detection section 35 for detecting whether or not the document P exists on the document mounting sections 10 and 11 is disposed downstream of the two-dimensional sensors 36, 37A, and 37B. The mounting detection section 35 includes a light source and a sensor that receives the reflected light component of the light emitted from the light source. It is possible for the controller 40 to detect existence of the document P on the document mounting sections 10 and 11 by the difference between the intensities of the reflected light when the document P exists on the document mounting sections 10 and 11 and when the document P does not exist.

A first document detection section 31 is disposed downstream of the feed roller 14. The first document detection section 31 includes an optical sensor as an example, and includes a light emitter 31*a* and a light receiver 31*b* that are disposed facing each other by sandwiching the document feed path T as illustrated in FIG. 2. The light receiver 31*b* transmits an electronic signal indicating the intensity of detection light to the controller 40 (FIG. 4). The transported document P blocks the detection light emitted from the light emitter 31*a* so that an electronic signal indicating the intensity of the detection light changes. Thereby it is possible for the controller 40 (FIG. 4) to detect the passing of the front end or the back end of the document P.

A double feed detection section 30 that detects double feed of the document P is disposed downstream of the first document detection section 31. As illustrated in FIG. 2, the double feed detection section 30 includes an ultrasonic transmitter 30*a* and an ultrasonic receiver 30*b* for receiving an ultrasonic wave, which are disposed facing each other by sandwiching the document feed path T. The ultrasonic receiver 30*b* transmits an output value in accordance with the intensity of the detected ultrasonic wave to the controller 40. When double feed of the document P occurs, the electronic signal indicating the intensity of the ultrasonic wave changes, and thereby, it is possible for the controller 40 to detect double feed of the document P.

A second document detection section 32 is disposed downstream of the double feed detection section 30. The second document detection section 32 is configured as a contact type sensor having a lever. When the lever is rotated by the document P passing the front end or the back end, the electronic signal transmitted from the second document detection section 32 to the controller 40 changes. Thereby, it is possible for the controller 40 to detect the document P passing the front end or the back end. It is possible for the controller 40 to obtain the position of the document P in the document feed path T by the first document detection section 31 and the second document detection section 32 described above.

Next, a description will be given of abnormality determination on transport of the document P using the two-dimensional sensors 36, 37A, and 37B. The scanner 1A according to the present embodiment performs abnormality determination on transport of the document P based on the detection values of the two-dimensional sensors 36, 37A, and 37B. When a predetermined condition is satisfied, transport of the document P is stopped because of the occurrence of an abnormality. In the embodiment, specifically, the feed motor 45 (FIG. 4) and the transport motor 46 (FIG. 4) are stopped. As described above, the two-dimensional sensors 36, 37A, and 37B include an image sensor 36*d* including an array of pixels arranged in a first axis Ax direction and a second axis Ay direction perpendicular to the first axis Ax direction. As illustrated in FIG. 3, the first axis Ax is disposed in the X direction, and in the second axis Ay is disposed in the Y direction.

First, an overview will be given of the determination control of transport abnormality with reference to FIG. 5. When a user performs document scan, the controller 40 initializes respective movement distances in the first axis Ax direction and the second axis Ay direction of the two-dimensional sensors 36, 37A, and 37B (step S101). A predetermined time period is waited (for example, 10 ms) (step S102), and the controller 40 obtains movement distances Wx and Wy from each of the two-dimensional sensors 36, 37A, and 37B (step S103). In this regard, every time a predetermined time period is waited (step S102), that is to say, every time the movement distances Wx and Wy are obtained, the movement distances Wx and Wy are initialized. Accordingly, the movement distances Wx and Wy obtained in step S103 become a movement speed per the predetermined time period.

The obtained movement distances Wx and Wy, in other words, a document movement speed per a predetermined time wait is compared with a threshold value (step S104 and S105). In step S104, Wx(37A) is a detection value in the first axis Ax direction of the two-dimensional sensor 37A, and Wx(37B) is a detection value in the first axis Ax direction of the two-dimensional sensor 37B. Also, in step S105, Wy(36) is a detection value in the second axis Ay direction of the two-dimensional sensor 36, Wy(37A) is a detection value in the second axis Ay direction of the two-dimensional sensor 37A, and Wy(37B) is a detection value in the second axis Ay direction of the two-dimensional sensor 37B.

Figure 6:
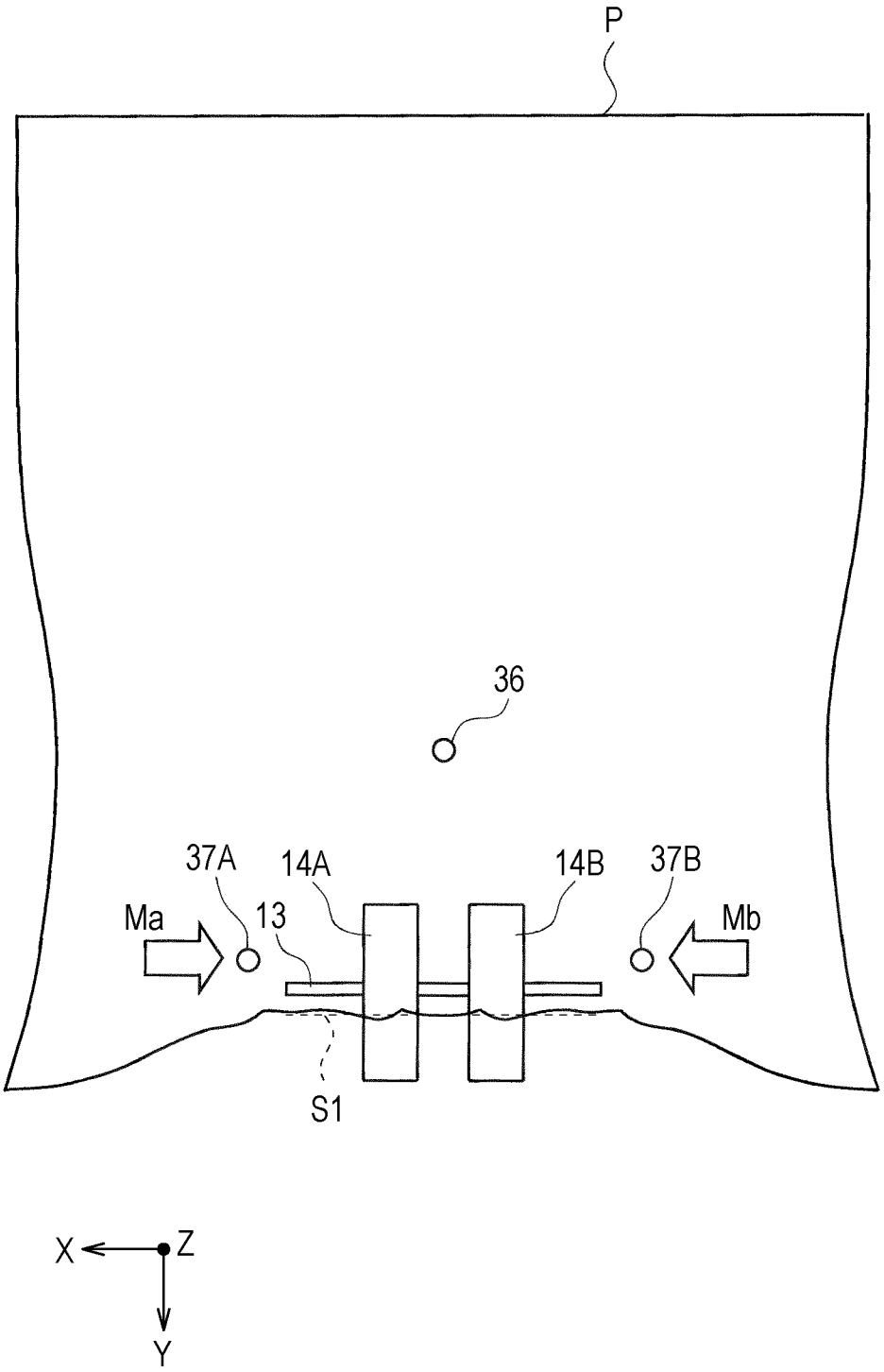
FIG. 6 is a diagram illustrating the state in which a crease occurs on a document.

In step S104, the controller 40 detects deformation of the document P due to a jam of the document P. A description will be given of a jam to be detected in step S104 with reference to FIG. 6. When the document P is a thin document in particular, the document top is turned up at the nipping position of the feed roller 14 and the separation roller 15. When the feed roller 14 started to rotate with a start of feeding, the document top is not nipped, and the feed roller 14 continues to rotate in that state. Accordingly, the document top is drawn nearer to the nipping position of the feed roller 14 and the separation roller 15, and thus a crease tends to be created. Arrows Ma and Mb denote the direction in which the document top is drawn nearer. When movements of the document top occur in the arrow directions Ma and Mb due to the jam described above, the detection values of the two-dimensional sensors 37A and 37B in the first axis Ax direction become the above-described state. Specifically, both detection values of the two-dimensional sensors 37A and 37B in the first axis Ax direction become the respective directions heading for the feed roller 14.

Figure 5:
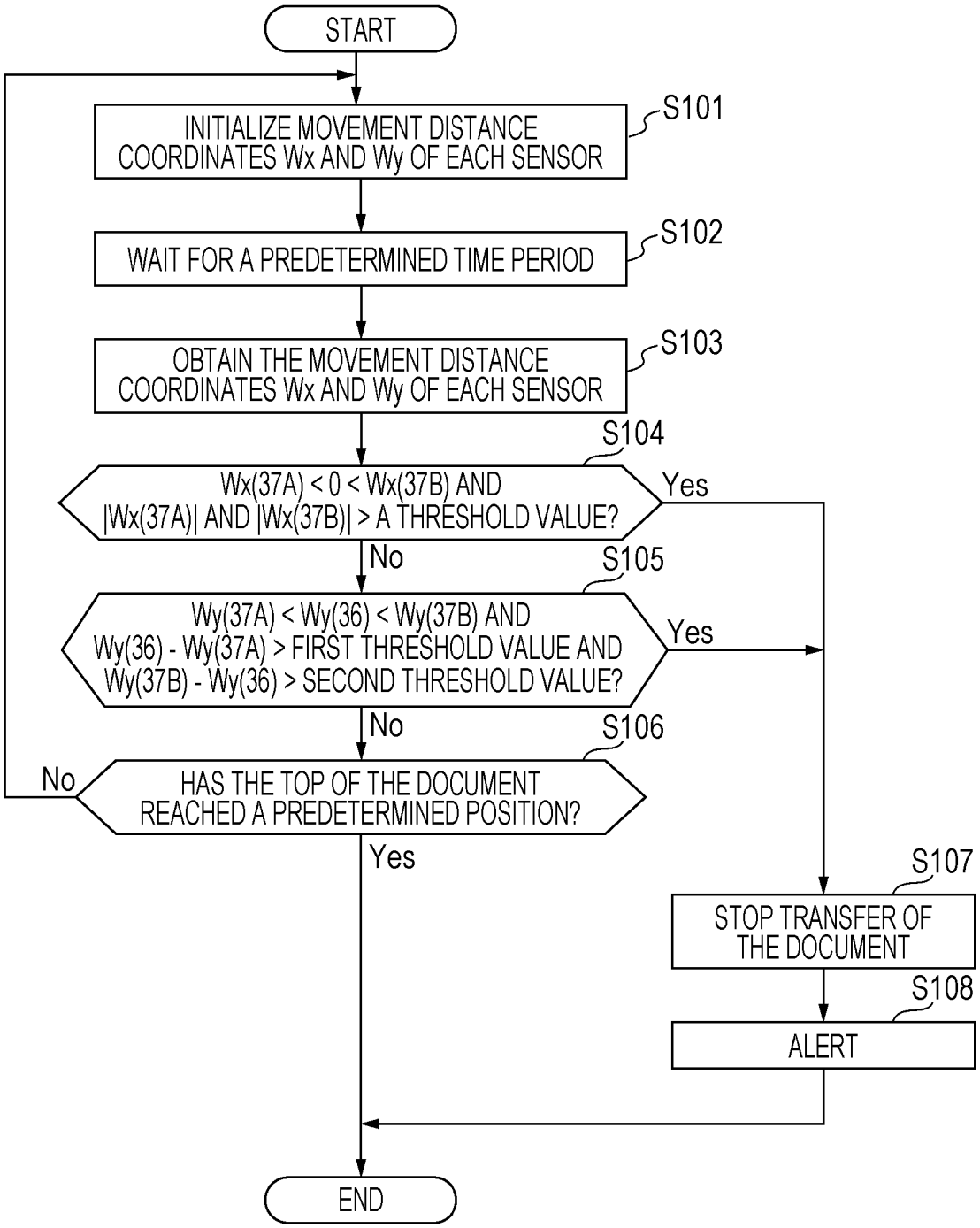
FIG. 5 is a flowchart of abnormality determination processing at the time of scanning a document.

Accordingly, in step S104 in FIG. 5, when a detection value Wx(37A) in the first axis Ax direction of the two-dimensional sensor 37A is a negative value, a detection value Wx(37B) in the first axis Ax direction of the two-dimensional sensor 37B is a positive value, and the respective absolute values thereof exceed a corresponding threshold value (Yes in step S104), the controller 40 determines that a transport abnormality has occurred, stops transport of the document P (step S107), and issues an alert stating that a transport abnormality has occurred (step S108).

Next, the controller 40 detects rotation of the document P in step S105. A description will be given of rotation of the document P to be detected in step S105 with reference to FIG. 7. When feed operation is started while the documents P1 and P2 are bound by the stale H at a position near the corner C1 of the front end, the document P1 that receives a feed force from the feed roller 14 is rotated in the direction denoted by arrow R with the staple H as center. This rotation is revealed at the positions of the two-dimensional sensors 37A, 37B, and 36 as the difference in the movements in the transport direction (second axis Ay direction) as denoted by arrows N1, N2, and N3. Specifically, the detection value in the second axis Ay direction of the two-dimensional sensor 37A, which is the nearest to the staple H, is lowest, and the detection value in the second axis Ay direction of the two-dimensional sensor 37B, which is the farthest from the staple H, becomes highest.

Accordingly, in step S105 in FIG. 5, when Wy(37A)<Wy(36)<Wy(37B), the result of Wy(36)-Wy(37A) is higher than a predetermined first threshold value, and the result of Wy(37B)−Wy(36) is higher than a predetermined second threshold value, the controller 40 determines that a transport abnormality has occurred, stops transfer of the document P (step S107), and issues an alert stating that a transport abnormality has occurred (step S108). In this regard, the first threshold value and the second threshold value are set to values that enable suitable detection of rotation of the document P1 illustrated in FIG. 7 in accordance with the disposition position of each sensor.

The above-described processing is performed until the document top reaches a predetermined position (step S106). In this regard, for example, the first document detection section 31 is given here as the predetermined position. However, if it is not possible for the first document detection section 31 to detect the document top even when the feed roller 14 is driven a predetermined amount, the controller 40 determines that a transport abnormality has occurred regardless of the determination in steps S104 and S105, stops transfer of the document P, and issues an alert stating that a transport abnormality has occurred.

As described above, a plurality of sensors (36, 37A, and 37B) that detect movement of the document P are disposed upstream of the nipping position between the feed roller 14 and the separation roller 15 with a gap in the document width direction, which intersects the document feed direction, and detect movement of the document P in the document width direction. Accordingly, it is possible for the controller 40 to promptly and correctly obtain movement of the document P based on the plurality of detection values obtained from the plurality of sensors (36, 37A, and 37B), and thus to suppress damage formation on the document P.

Also, the plurality of two-dimensional sensors include the two-dimensional sensor 37A as the first sensor and the two-dimensional sensor 37B as the second sensor disposed by sandwiching feed roller 14 and the separation roller 15 therebetween in the width direction. When both a movement of the document P in the width direction obtained by the two-dimensional sensor 37A and a movement of the document P in the width direction obtained by the two-dimensional sensor 37B are directed to the feed roller 14, and an amount of the movement exceeds a threshold value (Yes in step S104 in FIG. 5), the controller 40 stops feeding of the document P. Accordingly, it is possible to detect a crease described with reference to FIG. 6 in an early stage, and to suitably suppress damage formation on the document P.

In this regard, in step S104 in FIG. 5, the detection value Wx (Wx(36)) in the first axis Ax direction of the two-dimensional sensor 36 is not used. For example, in the state of the occurrence state of a crease described with reference to FIG. 6, there is substantially no movement in the first axis Ax direction of the two-dimensional sensor 36. Accordingly, it is possible to detect the occurrence of a crease described with reference to FIG. 6 by determining whether or not the difference between Wx(36) and Wx(37A) or the difference between Wx(36) and Wx(37B) exceeds a threshold value.

Also, since the plurality of sensors (the two-dimensional sensors 37A and 37B) detect movement of the document P in the document feed direction, it is possible for the controller 40 to promptly and correctly obtain movement of the document P based on a plurality of detection values obtained from the plurality of sensors (the two-dimensional sensors 37A and 37B), and to suppress damage formation on the document P.

Specifically, when the difference between the movement in the document feed direction of the document P obtained by the two-dimensional sensor 37A and the movement in the document feed direction of the document P obtained by the two-dimensional sensor 37B exceed a threshold value, the controller 40 stops feeding of the document P. Accordingly, it is possible to detect the rotation of the document P1, described with reference to FIG. 7, in an early stage, to detect a jam eventually in the early stage, and to suitably suppress damage formation on the document P.

Figure 7:
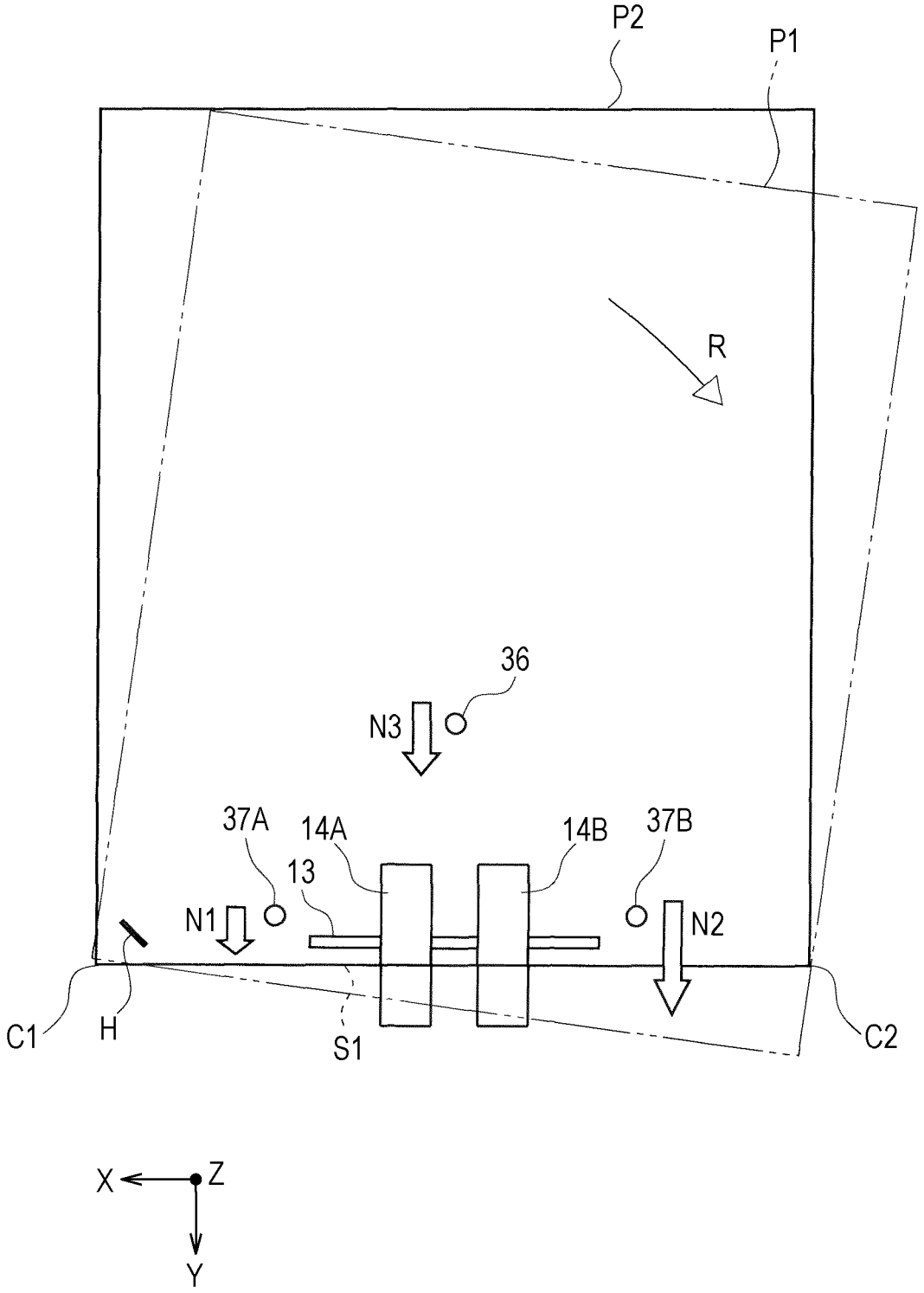
FIG. 7 is a diagram illustrating the state in which rotation occurs with a document.

In this regard, in the present embodiment, the plurality of sensors include the two-dimensional sensors 36, 37A, and 37B. In step S105 in FIG. 5, it is possible to improve the accuracy of rotation detection of the document P by using the detection value Wy(Wy(36)) in the second axis Ay direction of the two-dimensional sensor 36 in addition to the t detection values Wy(Wy(37A) and Wy(37B)) in the second axis Ay direction of the wo-dimensional sensors 37A and 37B. However, as illustrated in FIG. 7, when the document P1 is rotated, the difference arises between Wy(37A) and Wy(37B), and thus it is possible to detect rotation of the document P without using Wy(36). Alternatively, in the same manner, the difference arises between Wy(36) and Wy(37A), and thus it is possible to detect rotation of the document P without using Wy(37B). Alternatively, in the same manner, the difference arises between Wy(36) and Wy(37B), and thus, it is possible to detect rotation of the document P without using Wy(37A). However, as described above, it is possible to improve the accuracy of rotation detection of the document P by using the detection values of the three sensors.

Also, as described above, the plurality of sensors are the two-dimensional sensors (36, 37(A), and 37(B)) that detect the movement of the document P in the two-dimensional coordinate system including the first axis Ax and the second axis Ay. Accordingly, it is possible for one sensor to detect movements in the two directions of the document P, and to handle the both cases of the crease of the document P illustrated in FIG. 6 and the rotation of the document P illustrated in FIG. 7. However, it is possible for a sensor that detects a crease of the document P illustrated in FIG. 6 by a sensor configured to detect movement of a document in the document width direction. Accordingly, the sensor is not limited to a two-dimensional sensor, but ought to be a sensor capable of detecting movement in one direction of the document. In the same manner, since it is possible for a sensor capable of detecting movement in the document feed direction of the document to detect the rotation of the document P illustrated in FIG. 7, the sensor is not limited to the two-dimensional sensor, but ought to be a sensor capable of detecting movement in one direction of the document.

It is possible to make the following variations from the embodiment described above.

1. In the above-described embodiment, the description has been given of the case in which a plurality of sensors (36, 37A, and 37B) are applied to a scanner, which is an example of image reading apparatuses. However, it is possible to apply the technique to a recording apparatus including a recording head that records on the medium, which is represented by a printer.

2. In the above-described embodiment, determination of a transport abnormality by the plurality of sensors (36, 37A, and 37B) may be configured to change between a state to be executed and a state of not to be executed depending on a user setting.

3. In the above-described embodiment, the two-dimensional sensors (36, 37A, and 37B) have a controller 36*a* (FIG. 4). The controller 36*a* analyzes an image obtained by the image sensor 36*d* and outputs the movement amount in the first axis Ax direction of the image and the movement amount in the second axis Ay direction to the controller 40 as detection values (output values). However, the controller 40 may be configured to perform the function of the controller 36*a*.

4. In the above-described embodiment, the feed roller 14 and the two-dimensional sensors 36, 37A, and 37B are disposed facing the lowest position sheet of the document P among the sheets of the document P mounted on the document mounting section 11. However, the sensors may be disposed facing the highest position sheet of the document P among the sheets of the document P mounted on the document mounting section 11.

What is claimed is:

1. A medium transport apparatus comprising:

a medium mounting section configured to mount a medium;

a feed roller configured to feed the medium from the medium mounting section;

a separation roller configured to nip and separate the medium from the feed roller;

a plurality of sensors disposed at positions facing a surface of the medium and configured to detect movement of the medium; and a control unit configured to stop feeding of the medium based on detection values received from the sensors, wherein the plurality of sensors are disposed upstream of a nipping position by the feed roller and the separation roller with a gap in a width direction being a direction intersecting a medium feed direction and detect movement of the medium in the width direction, the plurality of sensors include a first sensor and a second sensor disposed by sandwiching the feed roller and the separation roller therebetween in the width direction; and when both a movement of the medium in the width direction obtained by the first sensor and a movement of the medium in the width direction obtained by the second sensor are directed to the feed roller, and an amount of the movement exceeds a threshold value, the control unit stops feeding of the medium.

2. The medium transport apparatus according to claim 1, wherein, the plurality of sensors include a downstream sensor located closer to an edge of the medium than the nipping position in the width direction, and an upstream sensor located upstream of the downstream sensor in the medium feed direction and disposed at a feed center position in the width direction, and when a movement in the width direction obtained by the downstream sensor is larger than a movement in the width direction obtained by the upstream sensor, and a difference thereof exceeds a threshold value, the control unit stops feeding of the medium.

3. The medium transport apparatus according to claim 1, wherein, a distance from one of corners of a medium front end to the first sensor is shorter than a distance from the corner to the second sensor, and when a difference between a detection value of the first sensor and a detection value of the second sensor exceeds a second threshold value, the control unit stops feeding of the medium.

4. The medium transport apparatus according to claim 1, wherein, the sensors are two-dimensional sensors that detect a movement of the medium in a two-dimensional coordinate system including a first axis and a second axis.

5. An image reading apparatus comprising:

a reading unit configured to read a medium; and the medium transport apparatus according to claim 1 that transports the medium to the reading unit.

6. A medium transport apparatus comprising:

a medium mounting section configured to mount a medium;

a feed roller configured to feed the medium from the medium mounting section;

a separation roller configured to nip and separate the medium from the feed roller;

a plurality of sensors disposed at positions facing a surface of the medium and configured to detect movement of the medium; and a control unit configured to stop feeding of the medium based on detection values received from the sensors, wherein the plurality of sensors are disposed upstream of a nipping position by the feed roller and the separation roller with a gap and detect movement of the medium in the medium feed direction, the plurality of sensors include a first sensor, a second sensor, and a third sensor, among distances from one corner of the medium front end to each of the sensors, a distance from the corner to the first sensor is shortest, and a distance from the corner to the second sensor is longest, and when a detection value by the first sensor is lowest, and a detection value by the second sensor is highest, a difference when a detection value by the third sensor is subtracted from a detection value of the second sensor exceeds a first threshold value, and a difference when a detection value by the first sensor is subtracted from a detection value of the second sensor exceeds a second threshold value, the control unit stops feeding of the medium.

7. A method of controlling transport in a medium transport apparatus including a medium mounting section configured to mount a medium, a feed roller configured to feed the medium from the medium mounting section, a separation roller configured to nip and separate the medium from the feed roller, a plurality of sensors disposed at positions facing a surface of the medium and configured to detect movement of the medium, wherein the plurality of sensors are disposed upstream of a nipping position by the feed roller and the separation roller with a gap in a width direction being a direction intersecting a medium feed direction and detect movement of the medium in the width direction, and the plurality of sensors include a first sensor and a second sensor disposed by sandwiching the feed roller and the separation roller therebetween in the width direction, the method comprising:

stopping feeding of the medium based on a plurality of detection values obtained from the plurality of sensors, wherein when both a movement of the medium in the width direction obtained by the first sensor and a movement of the medium in the width direction obtained by the second sensor are directed to the feed roller, and an amount of the movement exceeds a threshold value, the feeding of the medium is stopped.

* * * * *